United States Patent [19]

Petersen et al.

[11] Patent Number: 4,611,880

[45] Date of Patent: Sep. 16, 1986

[54] MULTIPIECE ELECTRICAL CONNECTOR

[75] Inventors: Carl C. Petersen, Binghamton; Richard W. Normann, Otego; Paul D. Niles, Bainbridge, all of N.Y.

[73] Assignee: Allied Corporation, Morristown, N.J.

[21] Appl. No.: 600,236

[22] Filed: Apr. 16, 1984

[51] Int. Cl.[4] ..... H01R 13/514

[52] U.S. Cl. ..... 339/206 R; 339/198 H; 339/210 M

[58] Field of Search ..... 339/59 R, 59 M, 63 R, 339/63 M, 176 M, 196 R, 196 A, 196 M, 198 H, 198 G, 210 R, 210 M, 206 R, 206 P, 198 R, 198 GA

[56] References Cited

U.S. PATENT DOCUMENTS 2,909,756 10/1959 Sitz ..... 339/59 M
3,397,384 8/1968 Lawrence ..... 339/176 M
3,471,822 10/1969 Van Baelen ..... 339/198 G
3,839,697 10/1974 Obert ..... 339/196
4,090,764 5/1978 Malsby et al. ..... 339/198 GA

*Primary Examiner*—Gil Weidenfeld
*Assistant Examiner*—Thomas M. Kline
*Attorney, Agent, or Firm*—C. D. Lacina; R. J. Eifler

[57] ABSTRACT

An easily assembled and disassembled rectangular connector assembly wherein contacts (30) are retained in a connector housing (10) by a plurality of segments (20) that are releasably mounted to the connector housing (10). The segments (20) are releasably mounted to the housing (10) by a plurality of resiliently deflectable fingers (13) having a flange (14) thereon that engages a shoulder (24) on each of the segments (20). A window (25) provides access to the flanges (14) so that the flanges (14) may be deflected and disengaged from the shoulder (24) on the segment (20).

4 Claims, 16 Drawing Figures

FIG. 11
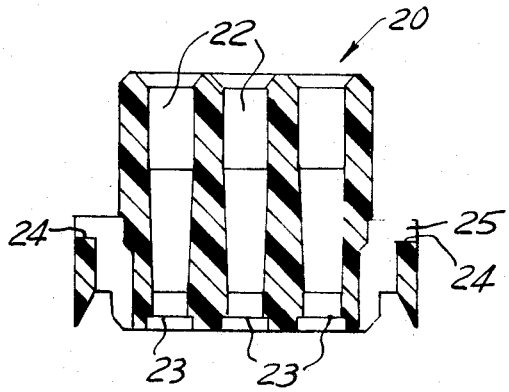
FIG. 8
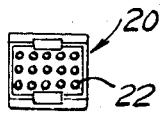
FIG. 9
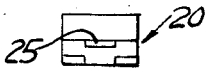
FIG. 10
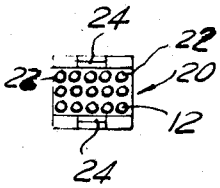
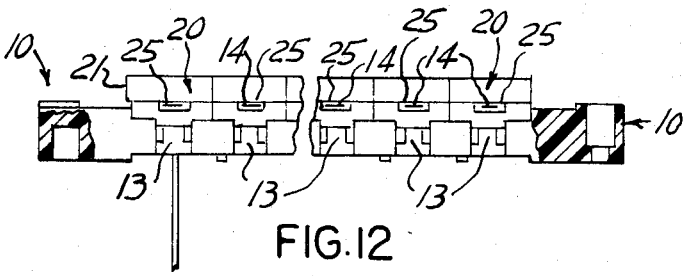
FIG. 12
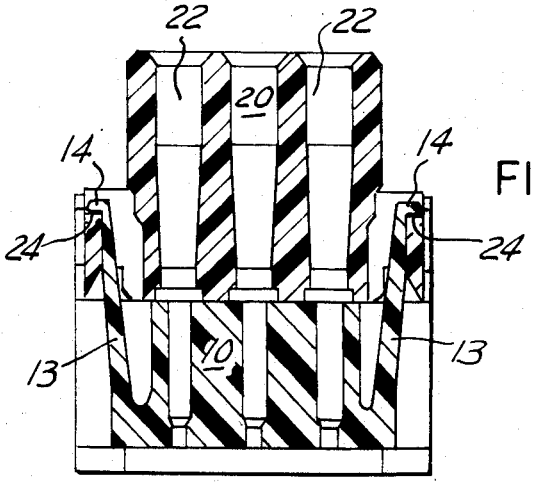
FIG. 13

MULTIPIECE ELECTRICAL CONNECTOR

This invention relates to electrical connectors, and more particularly, to connecting removable pieces or segments to the connector base or housing.

Rectangularly shaped connectors are widely known and used in the electrical arts. Ordinarily, rectangular connectors include a housing in which a plurality of electrical contacts are mounted. The contacts are generally retained in the connector housing by insertion into one end of respective axial passages each having contact retaining fingers that snap into place behind a shoulder of a contact. Because of this arrangement, the strength of the contact retention in the opposite axial direction is limited to the strength of the fingers that retain the contacts. In certain applications the contacts are subjected to an axial force against the contact retaining fingers of seven pounds or greater. As a result, some of the fingers fail causing a contact to be loosely retained or dislocated. One example of a rectangular connector may be found in U.S. Pat. No. 4,391,482 entitled "Spring Strips for Connections Between Printed Circuit Board", issued July 5, 1983. Another example of a rectangular connector having a modular type construction may be found in U.S. Pat. No. 3,471,822 entitled "Terminal Junction System for Electrical Conductors", issued Oct. 7, 1969. In the foregoing patents and in the prior art there is a need for a simple design of a rectangular connector that will retain the contacts in the connector housing when subjected to a force greater than seven pounds, and provide a simple mechanism for assembling the contacts in the connector and connecting the segments to the housing of the connector.

DISCLOSURE OF THE INVENTION

This invention provides a simply constructed rectangular multipiece electrical connector. The connector is characterized by a plurality of segments that are releasably retained by resiliently deflectable fingers extending from the housing of the connector. The segments and the housing cooperate to releasably retain the contacts of the connector.

Accordingly, it is an advantage of this invention to provide a multipiece electrical connector that is easily assembled and disassembled.

DETAILED DESCRIPTION OF THE INVENTION

FIGS. 5–11 illustrate the segments that may be releasably mounted to the connector housing.

FIGS. 12 and 13 illustrate the segments mounted to the connector housing.

Figure 1:
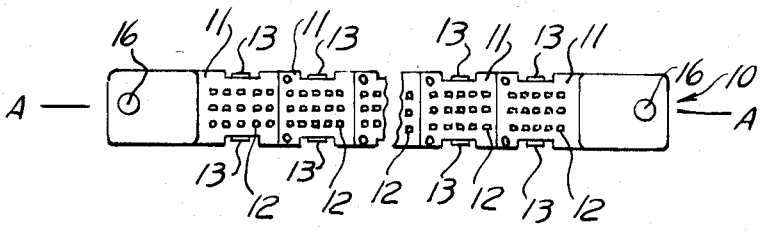
FIGS. 1–4 illustrate views of the base or housing portion of the connector assembly.

Referring now to the Drawings, FIG. 1 illustrates a bottom view of the connector housing 10. The connector housing 10 includes a plurality of sections 11 arranged along the longitudinal axis A of the connector housing 10. Each of the sections 11 includes a plurality of passages 12 arranged in a predetermined pattern and a latch member in the form of a resiliently deflectable finger 13 on each side of the housing sections 11. At opposite ends of the housing 10 are passages 16 for mounting the housing 10 to another member (not shown).

Figure 2:
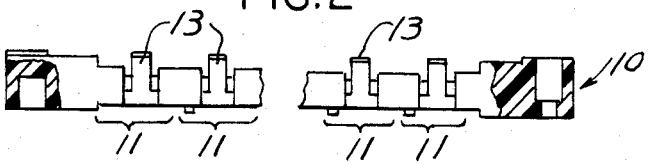

FIG. 2 is a side view of the housing 10 shown in FIG. 1 and illustrates the resiliently deflectable fingers 13 extending upwardly from each of the sections 11 in the connector housing 10. The housing 10 and fingers are preferably comprised of a plastic such as polyphenyl sulfide or polyamide.

Figure 3:
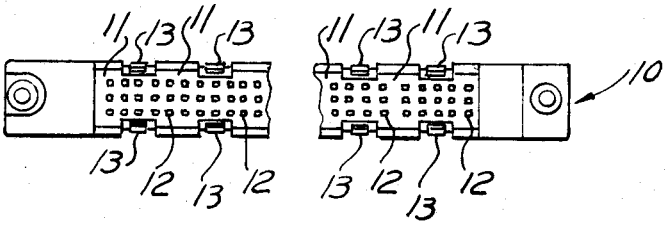

FIG. 3 is a top view of the connector housing 10.

Figure 4:
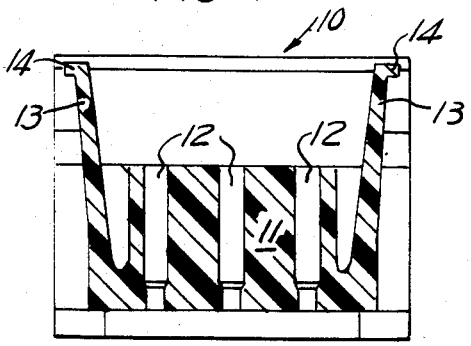

FIG. 4 is a cross section of the housing 10 showing the configuration of each of the sections 11 and the passages 12. Each of the resiliently deflectable fingers 13 include a flange portion 14 extending generally perpendicular to the central axis of each of the passages 12.

Figure 5:
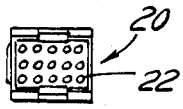

FIG. 5 illustrates a bottom view of a segment 20 that is adapted to be mounted to the sections 11 of the housing 10 shown in FIGS. 1 through 4. Each of the segments 20 includes a plurality of passages 22 arranged in the same manner as the passages 12 in the housing.

Figure 6:
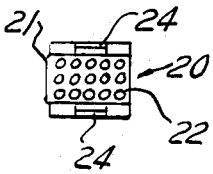

FIG. 6 is a top view of the segment 20 illustrating the shoulders 24 adapted to engage the flange portion 14 of the resilient fingers 13 shown in FIG. 4. In this embodiment of the segment 20 there is included a rounded side 21.

Figure 7:
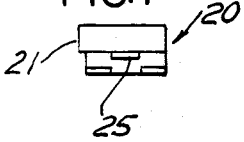

FIG. 7 is a side view of the segment 20 illustrating an opening or window 25 located on respective opposite sides of the segment 20 immediately adjacent respective shoulders on the segment 20.

FIGS. 8–10 illustrate segments 20 having all flat sides and may be used with the segments shown in FIGS. 5–7 to polarize a connector housing 10 by locating one of the segments 20 having a rounded side 21 (FIG. 6) in one of the end sections 11 of the connector housing 10.

FIG. 11 is a cross section of the segments 20 shown in FIGS. 5 through 7 and 8 through 10. Each of the segments 20 include passages 22 having at one end thereof an annular shoulder 23 adapted to engage the enlarged portion of respective contacts (not shown). The shoulders 24 on the sides of the segment 20 are adapted to engage the flange portion 14 of the resiliently deflectable fingers 13 shown in FIG. 4 and are accessible from the sides through respective openings 25.

FIG. 12 illustrates an arrangement wherein the segments 20 shown in FIGS. 5–7 are located in one end section of the housing 10 while the remaining segments are in the shape described in FIGS. 8–10. The windows 25 in each of the segments 20 provide access to the flange portions 14 of each of the resiliently deflectable fingers 13 to allow a tool to deflect and disengage the housing flanges 14 from the segment shoulders 24 so that a segment may be removed.

FIG. 13 illustrates how each of the segments 20 are mounted to the connector housing 10 by engagement of the flange portion 14 of the resiliently deflectable fingers 13 with the shoulder portion 24 of the segment 20.

Figure 14:
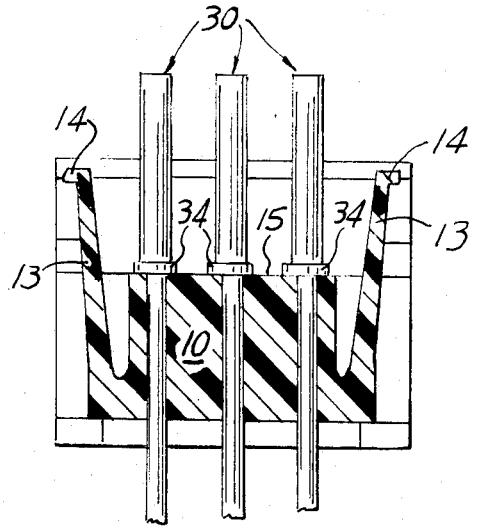
FIGS. 14, 15 and 16 illustrate how electrical contacts are assembled into the connector.

FIG. 14 illustrates how contacts 30 are located in the passages 12 in each section of the housing 10. Each of the contacts 30 includes an enlarged portion 34 that is positioned in the passage by engagement with a transverse surface 15 in each section of the housing 10.

Figure 15:
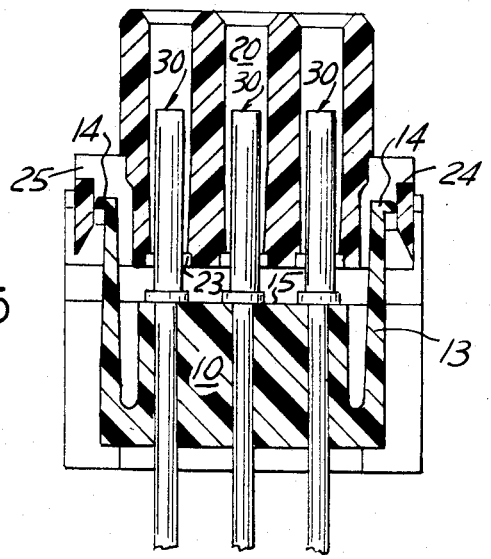

FIG. 15 illustrates a partially assembled connector wherein the fingers 13 of the housing section 11 are deflected and the finger flange 14 has not engaged the housing shoulder 24 and the contacts are not yet securely mounted in the connector.

Figure 16:
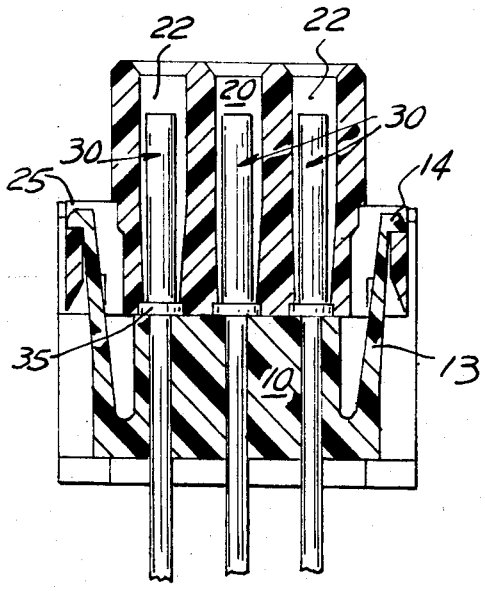

FIG. 16 illustrates an assembled connector with the segment 20 releasably connected to the section 11 of the housing 10. In this position the flanges 14 of each of the resiliently deflectable fingers 13 engage the shoulders 24 on the segment 20 to connect the housing 10 and segment 20 together and secure the contacts 30 within the connector. The contacts 30 are now retained in position by the transverse surface 15 of the housing section 11 and the annular shoulder 23 in the passages 22 of the segment 20 that captivate the enlarged section 35 of the contact 30.

To remove a segment 20 or a contact 30 from the housing 10 the sequence shown in FIGS. 14–16 is reversed. This is accomplished by deflecting the flange portions 14 of the deflectable fingers 13 inwardly to disengage the flanges 14 from the shoulders 24 and allow removal of the segment 20 and the contacts 30.

Having described the invention, what is claimed is:

1. A multipiece electrical connector comprising: a laterally elongated one-piece dielectric housing having a plurality of sections, each section having a plurality of passages having an axis perpendicular to the lateral axis of the elongated housing, a plurality of dielectric segments each being disposed in a respective section of said housing and each having a plurality of passages aligned with respective passages in said housing, a plurality of electrically conductive contacts each having a first portion disposed in a respective passage of one said housing section, a second portion disposed in a respective passage of one said segment associated with that section, and an enlarged portion captivated between its segment and housing section, and means for mounting each said segment to said housing section so that the enlarged portion of each said contact is mounted within said connector, characterized by said housing having its respective passages terminating on a generally flat top face and including at least one resiliently deflectable finger on at least side of each section, said fingers extending in the same general direction as the axis of said passages, each finger including a flange portion at the end thereof extending in a direction generally perpendicular to the axis of said passage, and each said segment having its passages terminating on a substantially flat bottom face and having at least one shoulder engaging a respective flange on a respective finger to secure each segment to its respective section of said housing, the passage of one said housing section and its associated segment defining an annular recess receiving said enlarged portion so that said top face is abutting said bottom face.

2. The multipiece electrical connector as described in claim 1 wherein each of the passages in said segments includes an annular countersunk recess, and the enlarged portion of each said contact defines a first face and a second face each of which are generally disposed in a plane perpendicular to the passages, the enlarged portion of each said contact being captivated within its respective recess so that one and the other said first face and said second face, respectively, abuts the top face of said housing, and the transverse countersunk surface of its recess.

3. The multipiece electrical connector as described in claim 1 wherein each of said segments includes an opening adjacent each of said shoulders, said opening aligned with the flange on a respective finger, whereby a tool may be inserted into said openings to deflect and disengage the flanges from engagement with the shoulders of said segment so that said segment may be removed from said housing.

4. The multipiece electrical connector as described in claim 2 wherein each of said segments includes an opening adjacent each of said shoulders, said opening aligned with the flange on a respective finger, whereby a tool may be inserted into said openings to deflect and disengage the flanges from engagement with the shoulders of said segment so that said segment may be removed from said housing.

* * * * *